US009892701B2

(12) United States Patent
Park et al.

(10) Patent No.: US 9,892,701 B2
(45) Date of Patent: Feb. 13, 2018

(54) DISPLAY APPARATUS

(71) Applicant: Samsung Display Co., Ltd., Yongin-si, Gyeonggi-do (KR)

(72) Inventors: Byoung-Haw Park, Osan-si (KR); Yong-Su Lim, Seoul (KR); Ji-Youn Seo, Asan-si (KR); Ye-Seul Lee, Cheonan-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 177 days.

(21) Appl. No.: 14/861,964

(22) Filed: Sep. 22, 2015

(65) Prior Publication Data

US 2016/0118006 A1 Apr. 28, 2016

(30) Foreign Application Priority Data

Oct. 23, 2014 (KR) ..... 10-2014-0144447

(51) Int. Cl.
*G09G 3/36* (2006.01)

(52) U.S. Cl.
CPC ..... *G09G 3/3648* (2013.01); *G09G 3/3666* (2013.01); *G09G 3/3688* (2013.01); *G09G 2300/0426* (2013.01); *G09G 2310/0202* (2013.01); *G09G 2320/0223* (2013.01); *G09G 2330/026* (2013.01); *G09G 2330/12* (2013.01)

(58) Field of Classification Search
CPC ... G09G 2300/0426; G09G 2310/0202; G09G 2320/0223; G09G 2330/026; G09G 2330/12; G09G 3/3648; G09G 3/3666; G09G 3/3688
See application file for complete search history.

(56) References Cited

U.S. PATENT DOCUMENTS

2004/0061675 A1* 4/2004 Hirakawa ..... G09G 5/008 345/88
2006/0114216 A1* 6/2006 Shim ..... G09G 3/3677 345/100
2007/0024565 A1* 2/2007 Choi ..... G09G 3/3655 345/98
2007/0120780 A1* 5/2007 Park ..... G09G 3/3291 345/76

(Continued)

FOREIGN PATENT DOCUMENTS

KR 10-2007-0017626 A 2/2007
KR 10-2008-0053781 A 6/2008

(Continued)

*Primary Examiner* — Viet Pham
(74) *Attorney, Agent, or Firm* — Lewis Roca Rothgerber Christie LLP

(57) ABSTRACT

A display apparatus including a display panel connected to a plurality of data lines, a data driver configured to generate a plurality of data voltages, and to apply the plurality of data voltages to the plurality of data lines, and a plurality of feedback lines disposed in a fan-out region between the display panel and the data driver, wherein the data driver is further configured to applies a first signal to each of the plurality of feedback lines, wherein delays by the fan-out region are obtained based on the first signal, the delays being associated with the plurality of data lines, and wherein the data driver is further configured to controls output times of the plurality of data voltages based on the delays.

20 Claims, 11 Drawing Sheets

(56) References Cited

U.S. PATENT DOCUMENTS

| | | | | |
|---|---|---|---|---|
| 2008/0049156 | A1* | 2/2008 | Kim | G02F 1/136286 349/40 |
| 2008/0259010 | A1* | 10/2008 | Ma | G09G 3/3674 345/87 |
| 2009/0135124 | A1* | 5/2009 | Nakatsuka | G09G 3/3655 345/94 |
| 2010/0053056 | A1* | 3/2010 | Lee | G02F 1/1345 345/94 |
| 2010/0110058 | A1* | 5/2010 | Moh | G09G 3/3655 345/211 |
| 2014/0028535 | A1* | 1/2014 | Min | G09G 3/18 345/87 |
| 2014/0176839 | A1* | 6/2014 | Oh | G09G 3/3655 349/33 |

FOREIGN PATENT DOCUMENTS

| | | | |
|---|---|---|---|
| KR | 10-2011-0006969 | A | 1/2011 |
| KR | 10-2014-0013523 | A | 2/2014 |

* cited by examiner

DISPLAY APPARATUS

CROSS-REFERENCE TO RELATED APPLICATION

This application claims priority to and the benefit of Korean Patent Application No. 10-2014-0144447, filed on Oct. 23, 2014 in the Korean Intellectual Property Office (KIPO), the content of which is herein incorporated by reference in its entirety.

BACKGROUND

1. Field

Aspects of one or more embodiments relate to display apparatuses.

2. Description of the Related Art

Generally, a display apparatus includes a display panel and a data driver. The data driver applies a plurality of data voltages corresponding to image data to the display panel via a plurality of data lines.

Conventionally, as the size of the display panel has increased, a first data line located in an edge region of the display panel has become longer than a second data line located in a central region of the display panel. In this case, a time at which a first data voltage is applied to a first pixel connected to the first data line may be different from a time at which a second data voltage is applied to a second pixel connected to the second data line. In other words, there may be transmission delay between the first data voltage and the second data voltage.

To compensate such transmission delay due to a difference between lengths of the data lines, it has been adopted to adjust the lengths of the data lines, e.g., by lengthening the second data line located in the central region of the display panel, such that all of the data lines have substantially the same length. However, if the lengths of some data lines are lengthened, the display panel may have a relatively large fan-out region and a relatively large bezel width.

SUMMARY

Accordingly, the present disclosure is provided to substantially obviate one or more problems due to limitations and disadvantages of the related art.

One or more example embodiments of the present disclosure are directed toward a display apparatus capable of having a relatively small bezel width.

According to some example embodiments, there is provided a display apparatus including: a display panel connected to a plurality of data lines; a data driver configured to generate a plurality of data voltages, and to apply the plurality of data voltages to the plurality of data lines; and a plurality of feedback lines disposed in a fan-out region between the display panel and the data driver, wherein the data driver is further configured to applies a first signal to each of the plurality of feedback lines, wherein delays by the fan-out region are obtained based on the first signal, the delays being associated with the plurality of data lines, and wherein the data driver is further configured to controls output times of the plurality of data voltages based on the delays.

In an embodiment, the plurality of feedback lines includes: a first feedback line disposed in the fan-out region and adjacent to a first data line among the plurality of data lines, the first data line being located in a first edge region of the display panel; a second feedback line disposed in the fan-out region and adjacent to a second data line among the plurality of data lines, the second data line being located in a central region of the display panel; and a third feedback line disposed in the fan-out region and adjacent to a third data line among the plurality of data lines, the third data line being located in a second edge region of the display panel opposite to the first edge region of the display panel.

In an embodiment, the first feedback line includes a first end configured to receiving the first signal and a second end configured to outputting the first signal, and wherein a first delay associated with the first data line is obtained based on a time interval between a first time point at which the first signal is applied to the first end of the first feedback line and a second time point at which the first signal is output from the second end of the first feedback line.

In an embodiment, a first delay associated with the first data line is obtained based on the first signal applied to the first feedback line, a second delay associated with the second data line is obtained based on the first signal applied to the second feedback line, and a third delay associated with the third data line is obtained based on the first signal applied to the third feedback line, and wherein delays other than the first, second, and third delays are obtained by performing an interpolation operation based on the first, second, and third delays, the delays other than the first, second and third delays being associated with data lines other than the first, second, and third data lines.

In an embodiment, the data driver includes: a first feedback circuit configured to apply the first signal to the first feedback line to traverse and be output from the first feedback line, and configured to provide the first signal output from the first feedback line to an external timing controller; a second feedback circuit configured to apply the first signal to the second feedback line to traverse and be output from the second feedback line, and configured to provide the first signal output from the second feedback line to the external timing controller; and a third feedback circuit configured to apply the first signal to the third feedback line to traverse and be output from the third feedback line, and configured to provide the first signal output from the third feedback line to the external timing controller.

In an embodiment, the first feedback circuit includes: a first switch configured to selectively apply the first signal to a first end of the first feedback line based on a first switch control signal, the applied first signal traversing and being output from a second end of the first feedback line; and a second switch configured to selectively provide the first signal output from a the second end of the first feedback line to the external timing controller based on the first switch control signal.

In an embodiment, the data driver includes: a first feedback circuit configured to apply the first signal to the first feedback line to traverse and be output from the first feedback line, and configured to obtain a first delay associated with the first data line based on the first signal output from the first feedback line; a second feedback circuit configured to apply the first signal to the second feedback line to traverse and be output from the second feedback line, and configured to obtain a second delay associated with the second data line based on the first signal output from the second feedback line; and a third feedback circuit configured to apply the first signal to the third feedback line to traverse and be output from the third feedback line, and configured to obtain a third delay associated with the third data line based on the first signal output from the third feedback line.

In an embodiment, the first feedback circuit includes: a first switch configured to selectively apply the first signal to a first end of the first feedback line based on a first switch control signal; and a first counter configured to obtain the first delay by counting a time interval between a first time point at which the first signal is applied to the first end of the first feedback line and a second time point at which the first signal is output from a second end of the first feedback line.

In an embodiment, the data driver further includes: a storage configured to store the first delay, the second delay, and the third delay.

In an embodiment, the display apparatus further includes: a timing controller configured to control an operation of the data driver, wherein the first delay, the second delay, and the third delay are stored in the timing controller.

In an embodiment, the delays are obtained while the display apparatus receives a boot-up command from an external host to perform a boot-up operation.

According to some example embodiments, there is provided a display apparatus including: a display panel connected to a plurality of data lines, the display panel being divided into a first display area and a second display area; a first data driver configured to generate a plurality of first data voltages, and to apply the plurality of first data voltages to a first group of data lines among the plurality of data lines, the first group of data lines being disposed in the first display area; a second data driver configured to generate a plurality of second data voltages, and to apply the plurality of second data voltages to a second group of data lines among the plurality of data lines, the second group of data lines being disposed in the second display area; and a plurality of feedback lines disposed in a fan-out region between the display panel and the first and second data drivers, wherein the first and second data drivers are configured to apply a first signal to each of the plurality of feedback lines, wherein delays by the fan-out region are obtained based on the first signal, the delays being associated with the plurality of data lines, and wherein the first and second data drivers are further configured to control output times of the plurality of first and second data voltages based on the delays.

In an embodiment, the plurality of feedback lines includes: a first feedback line disposed in the fan-out region and adjacent to a first data line among the first group of data lines, the first data line being located in a first edge region of the first display area; a second feedback line disposed in the fan-out region and adjacent to a second data line among the first group of data lines, the second data line being located in a central region of the first display area; and a third feedback line disposed in the fan-out region and adjacent to a third data line among the first group of data lines, the third data line being located in a second edge region of the first display area opposite to the first edge region of the first display area.

In an embodiment, the first feedback line includes a first end configured to receiving the first signal and a second end configured to outputting the first signal, and wherein a first delay associated with the first data line is obtained based on a time interval between a first time point at which the first signal is applied to the first end of the first feedback line and a second time point at which the first signal is output from the second end of the first feedback line.

In an embodiment, a first delay associated with the first data line is obtained based on the first signal applied to the first feedback line, a second delay associated with the second data line is obtained based on the first signal applied to the second feedback line, and a third delay associated with the third data line is obtained based on the first signal applied to the third feedback line, and wherein delays other than the first, second, and third delays are obtained by performing an interpolation operation based on the first, second, and third delays, the delays other than the first, second, and third delays being associated with data lines other than the first, second, and third data lines.

In an embodiment, the data driver includes: a first feedback circuit configured to apply the first signal to the first feedback line to traverse and be output from the first feedback line, and configured to provide the first signal output from the first feedback line to an external timing controller; a second feedback circuit configured to apply the first signal to the second feedback line to traverse and be output from the second feedback line, and configured to provide the first signal output from the second feedback line to the external timing controller; and a third feedback circuit configured to apply the first signal to the third feedback line to traverse and be output from the third feedback line, and configured to provide the first signal output from the third feedback line to the external timing controller.

In an embodiment, the data driver includes: a first feedback circuit configured to apply the first signal to the first feedback line to traverse and be output from the first feedback line, and configured to obtain a first delay associated with the first data line based on the first signal output from the first feedback line; a second feedback circuit configured to apply the first signal to the second feedback line to traverse and be output from the second feedback line, and configured to obtain a second delay associated with the second data line based on the first signal output from the second feedback line; and a third feedback circuit configured to apply the first signal to the third feedback line to traverse and be output from the third feedback line, and configured to obtain a third delay associated with the third data line based on the first signal output from the third feedback line.

In an embodiment, the plurality of feedback lines further includes: a fourth feedback line disposed in the fan-out region and adjacent to a fourth data line among the second group of data lines, the fourth data line being located in a third edge region of the second display area; a fifth feedback line disposed in the fan-out region and adjacent to a fifth data line among the second group of data lines, the fifth data line being located in a central region of the second display area; and a sixth feedback line disposed in the fan-out region and adjacent to a sixth data line among the second group of data lines, the sixth data line being located in a fourth edge region of the second display area opposite to the third edge region of the second display area.

In an embodiment, the delays are obtained while the display apparatus receives a boot-up command from an external host to perform a boot-up operation.

According to some example embodiments, there is provided a display apparatus including: a display panel connected to a plurality of gate lines; a gate driver configured to generate a plurality of gate signals, and to apply the plurality of gate signals to the plurality of gate lines; and a plurality of feedback lines disposed in a fan-out region between the display panel and the gate driver, wherein the gate driver is further configured to applies a first signal to each of the plurality of feedback lines, wherein delays by the fan-out region are obtained based on the first signal, the delays being associated with the plurality of gate lines, and wherein the gate driver is further configured to controls output times of the plurality of gate signals based on the delays.

The display apparatus, according to some example embodiments, may include the plurality of feedback lines that are located in the fan-out region and are separated from the data lines and/or the gate lines. The outputs of the data voltages and/or the gate signals may be controlled based on the delays that are detected and obtained with the plurality of feedback lines. Accordingly, transmission delay due to the length differences between the data lines and/or the gate lines may be compensated (e.g., efficiently compensated), and thus display apparatus may have a relatively improved (e.g., higher) image quality and a relatively improved (e.g., higher) performance.

BRIEF DESCRIPTION OF THE DRAWINGS

Illustrative, non-limiting example embodiments will be more clearly understood from the following detailed description taken in conjunction with the accompanying drawings.

DETAILED DESCRIPTION

Figure 1:
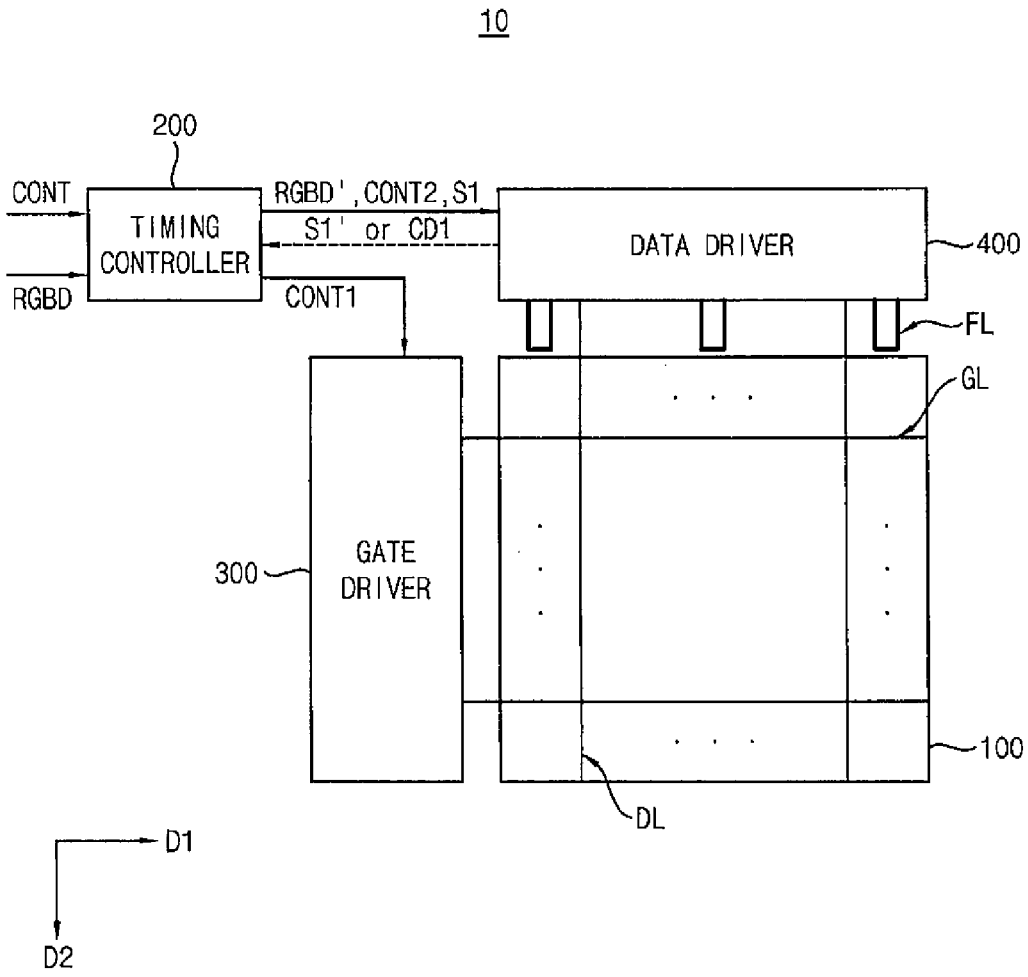
FIG. 1 is a block diagram illustrating a display apparatus according to some example embodiments.

Various example embodiments will be described more fully with reference to the accompanying drawings, in which some embodiments are shown. This inventive concept may, however, be embodied in many different forms and should not be construed as limited to the embodiments set forth herein. Rather, these embodiments are provided so that this disclosure will be thorough and complete, and will fully convey the scope of the inventive concept to those skilled in the art. Like reference numerals refer to like elements throughout this application.

It will be understood that, although the terms first, second, etc. may be used herein to describe various elements, these elements should not be limited by these terms. These terms are used to distinguish one element from another. For example, a first element could be termed a second element, and, similarly, a second element could be termed a first element, without departing from the scope of the inventive concept. As used herein, the term "and/or" includes any and all combinations of one or more of the associated listed items.

It will be understood that when an element is referred to as being "connected" or "coupled" to another element, it can be directly connected or coupled to the other element or one or more intervening element(s) may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular embodiments and is not intended to be limiting of the inventive concept. As used herein, the singular forms "a," "an" and "the" are intended to include the plural forms as well, unless the context clearly indicates otherwise. It will be further understood that the terms "comprises," "comprising," "includes" and/or "includihg," when used herein, specify the presence of stated features, integers, steps, operations, elements, and/or components, but do not preclude the presence or addition of one or more other.

Unless otherwise defined, all terms (including technical and scientific terms) used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

FIG. 1 is a block diagram illustrating a display apparatus according to some example embodiments.

Referring to FIG. 1, a display apparatus 10 includes a display panel 100, a timing controller 200, a gate driver 300, a data driver 400 and a plurality of feedback lines FL.

The display panel 100 is connected to a plurality of gate lines GL and a plurality of data lines DL. The display panel 100 displays an image having a plurality of grayscale levels based on output image data RGBD'. The gate lines GL may extend in a first direction D1, and the data lines DL may extend in a second direction D2 crossing (e.g., substantially perpendicular to) the first direction D1.

The display panel 100 may include a plurality of pixels that are arranged in a matrix form. Each pixel may be electrically connected to a respective one of the gate lines GL and a respective one of the data lines DL.

Each pixel may include a switching element, a liquid crystal capacitor, and a storage capacitor. The liquid crystal capacitor and the storage capacitor may be electrically connected to the switching element. For example, the switching element may be a thin film transistor. The liquid crystal capacitor may include a first electrode connected to a pixel electrode and a second electrode connected to a common electrode. A data voltage may be applied to the first electrode of the liquid crystal capacitor. A common voltage may be applied to the second electrode of the liquid crystal capacitor. The storage capacitor may include a first electrode connected to the pixel electrode and a second electrode connected to a storage electrode. The data voltage may be applied to the first electrode of the storage capacitor. A storage voltage may be applied to the second electrode of the storage capacitor. The storage voltage may be substantially equal to the common voltage.

Each pixel may have a rectangular shape. For example, each pixel may have a relatively short side in the first direction D1 and a relatively long side in the second direction D2. The relatively short side of each pixel may be substantially parallel to the gate lines GL. The relatively long side of each pixel may be substantially parallel to the data lines DL.

The timing controller 200 controls an operation of the display panel 100 and controls operations of the gate driver 300 and the data driver 400. The timing controller 200 receives input image data RGBD and an input control signal CONT from an external device (e.g., a host). The input image data RGBD may include a plurality of input pixel data for the plurality of pixels. Each input pixel data may include red grayscale data R, green grayscale data G and blue grayscale data B for a respective one of the plurality of pixels. The input control signal CONT may include a master clock signal, a data enable signal, a vertical synchronization signal, a horizontal synchronization signal, etc.

The timing controller 200 generates the output image data RGBD', a first control signal CONT1, a second control signal CONT2 and a first signal S1 based on the input image data RGBD and the input control signal CONT.

For example, the timing controller 200 may generate the output image data RGBD' based on the input image data RGBD. The output image data RGBD' may be provided to the data driver 400. In some example embodiments, the output image data RGBD' may be image data that is substantially the same as the input image data RGBD. In other example embodiments, the output image data RGBD' may be compensated image data that is generated by compensating the input image data RGBD. Similarly to the input image data RGBD, the output image data RGBD' may include a plurality of output pixel data for the plurality of pixels.

The timing controller 200 may generate the first control signal CONT1 based on the input control signal CONT. The first control signal CONT1 may be provided to the gate driver 300, and a driving time of the gate driver 300 may be controlled based on the first control signal CONT1. The first control signal CONT1 may include a vertical start signal, a gate clock signal, etc. The timing controller 200 may generate the second control signal CONT2 based on the input control signal CONT. The second control signal CONT2 may be provided to the data driver 400, and a driving time of the data driver 400 may be controlled based on the second control signal CONT2. The second control signal CONT2 may include a horizontal start signal, a data clock signal, a data load signal, a polarity control signal, etc.

In addition, the timing controller 200 generates the first signal S1 based on the input control signal CONT. The first signal S1 may be provided to the data driver 400. For example, the first signal S1 may be a test signal that includes a clock signal and/or a test pattern (e.g., a predetermined test pattern).

The plurality of feedback lines FL are located in a fan-out region between the display panel 100 and the data driver 400. To detect and obtain delays, which are associated with the plurality of data lines DL and are caused by the fan-out region, the display apparatus may include the plurality of feedback lines FL that are separated from the plurality of data lines DL.

The gate driver 300 receives the first control signal CONT1 from the timing controller 200. The gate driver 300 generates a plurality of gate signals for driving the gate lines GL based on the first control signal CONT1. The gate driver 300 may sequentially apply the plurality of gate signals to the gate lines GL.

The data driver 400 receives the second control signal CONT2 and the output image data RGBD' from the timing controller 200. The data driver 400 generates a plurality of data voltages (e.g., analog data voltages) based on the second control signal CONT2 and the output image data RGBD' (e.g., digital image data). The data driver 400 may apply the plurality of data voltages to the data lines DL.

In addition, the data driver 400 receives the first signal S1 from the timing controller 200. The data driver 400 applies the first signal S1 to each of the plurality of feedback lines FL. The delays by the fan-out region are obtained based on the first signal S1. The data driver 400 controls outputs (e.g., driving times) of the plurality of data voltages based on the delays. The data driver 400 may provide a delayed first signal S1' that is delayed (e.g., lagged) by passing through each of the plurality of feedback lines FL to the timing controller 200 or may provide a count signal CD1 corresponding to the delays of the timing controller 200.

Detailed configurations and operations of the data driver 400 will be further described below with reference to FIGS. 3 through 7.

In some example embodiments, the delays may be obtained while the display apparatus 10 receives a boot-up command from the external host to perform a boot-up operation.

In some example embodiments, the gate driver 300 and/or the data driver 400 may be located (e.g., directly mounted) on the display panel 100, or may be connected to the display panel 100 via a tape carrier package ("TCP"). Alternatively, the gate driver 300 and/or the data driver 400 may be integrated on the display panel 100.

Figure 2:
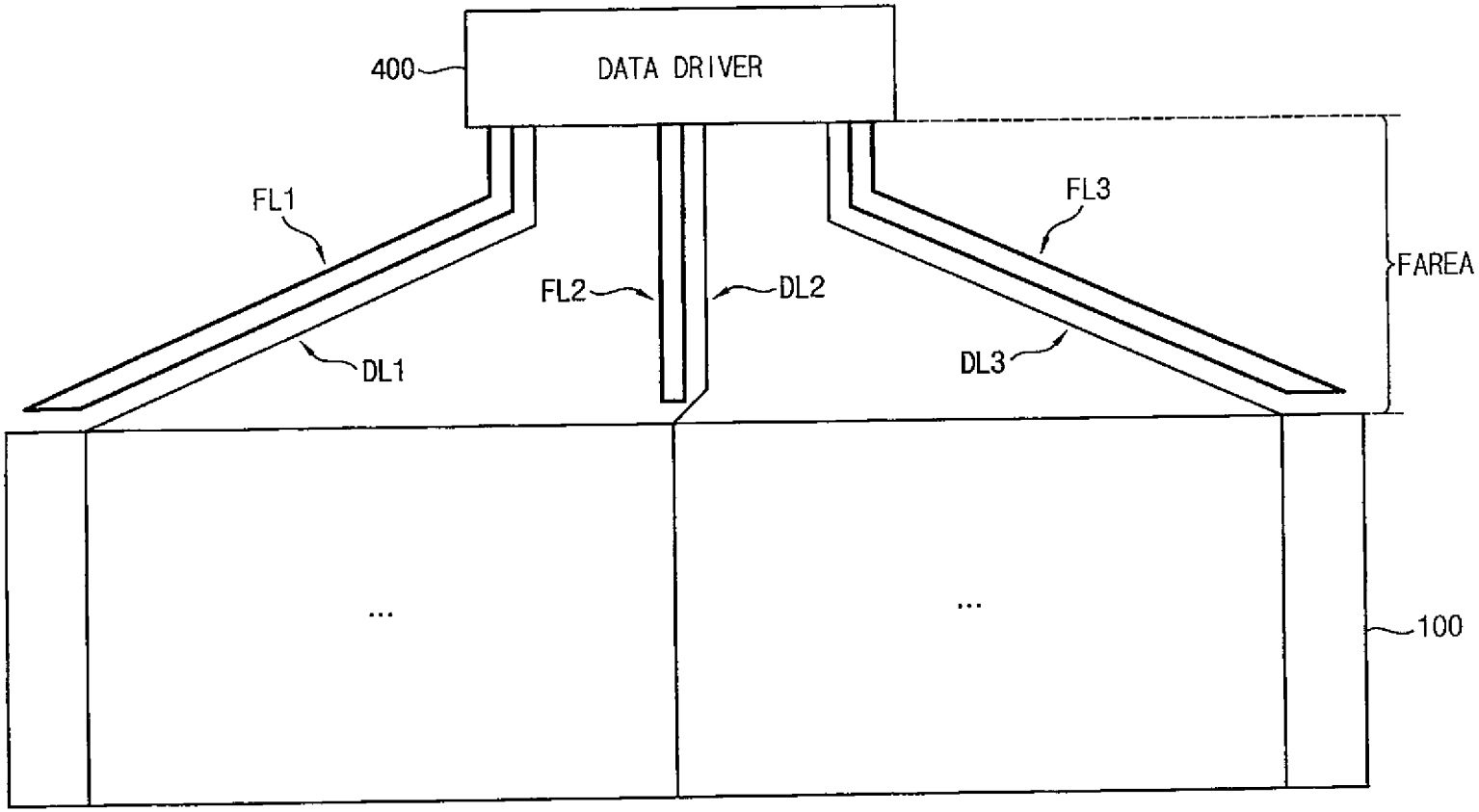
FIG. 2 is a diagram for describing an arrangement of a plurality of feedback lines included in the display apparatus of FIG. 1.

FIG. 2 is a diagram for describing an arrangement of a plurality of feedback lines included in the display apparatus of FIG. 1.

Referring to FIGS. 1 and 2, the plurality of feedback lines FL may be located in a fan-out region FAREA and may be separated from the plurality of data lines DL. The fan-out region FAREA may be defined as a region where lines (e.g., the data lines DL) are located between the display panel 100 and the data driver 400.

The plurality of data lines DL may include a first data line DL1, a second data line DL2, and a third data line DL3. The first data line DL1 may be located in a first edge region of the display panel 100. The second data line DL2 may be located in a central region of the display panel 100. The third data line DL3 may be located in a second edge region of the display panel 100 opposite to the first edge region of the display panel 100. As illustrated in FIG. 2, the data lines DL1 and DL3 that are located in the edge regions of the display panel 100 may be longer than the data line DL2 that is located in the central region of the display panel 100. Thus, a transmission of a data voltage to the edge regions of the display panel 100 may be relatively delayed.

The plurality of feedback lines FL may include a first feedback line FL1, a second feedback line FL2 and a third feedback line FL3. The first feedback line FL1 may be located in the fan-out region FAREA and may be located adjacent to the first data line DL1. The second feedback line FL2 may be located in the fan-out region FAREA and may be located adjacent to the second data line DL2. The third feedback line FL3 may be located in the fan-out region FAREA and may be located adjacent to the third data line DL3.

A length of a respective one of the feedback lines may correspond to a length of a portion of a respective one of the data lines within the fan-out region FAREA. The respective one of the feedback lines may be located adjacent to the respective one of the data lines. For example, the first feedback line FL1 may be about twice as long as a portion of the first data line DL1 within the fan-out region FAREA. The second feedback line FL2 may be about twice as long as a portion of the second data line DL2 within the fan-out region FAREA. The third feedback line FL3 may be about twice as long as a portion of the third data line DL3 within the fan-out region FAREA. Length differences between the data lines DL may be caused by the fan-out region FAREA, and lengths of portions of the data lines DL within an active region of the display panel 100 may be substantially the same as each other. Thus, the delays associated with the data lines DL may be detected (e.g., efficiently detected) even if the feedback lines FL are only located in the fan-out region FAREA.

In some example embodiments, each feedback line may have a first end receiving the first signal S1 and a second end outputting the delayed first signal S1'. The delayed first signal S1' may be delayed (e.g., lagged) by passing through each feedback line. For example, the first feedback line FL1 may have a first end receiving the first signal S1 and a second end outputting the delayed first signal S1' delayed (e.g., lagged) by passing through the first feedback line FL1. A first delay associated with the first data line may be obtained based on a time interval between a first time at which the first signal S1 is applied to the first end of the first feedback line FL1 and a second time at which the delayed first signal S1' is output from the second end of the first feedback line FL1.

As described above, the first delay associated with the first data line DL1 may be obtained based on the first signal S1 applied to the first feedback line FL1. Similarly, a second delay associated with the second data line DL2 may be obtained based on the first signal S1 applied to the second feedback line FL2, and a third delay associated with the third data line DL3 may be obtained based on the first signal S1 applied to the third feedback line FL3. Some data lines may be located between the first data line DL1 and the second data line DL2, and other data lines may be located between the second data line DL2 and the third data line DL3. Delays other than the first, second, and third delays may be obtained by performing an interpolation operation based on the first, second, and third delays. The delays other than the first, second, and third delays may be associated with data lines other than the first, second, and third data lines DL1, DL2 and DL3 (e.g., the data lines between the first and second data lines DL1 and DL2 and between the second and third data lines DL2 and DL3).

The plurality of feedback lines FL and the plurality of data lines DL may be formed on the same layer. Although FIG. 2 illustrates an example where the display apparatus 10 includes three feedback lines FL1, FL2 and FL3, the number of the feedback lines may not be limited thereto, but may be changed.

The display apparatus 10, according to some example embodiments, may include the plurality of feedback lines FL that are located in the fan-out region FAREA and are separated from the plurality of data lines DL. The outputs (e.g., driving times) of the plurality of data voltages may be controlled based on the delays that are detected and obtained based on the plurality of feedback lines FL. Accordingly, transmission delay due to the length differences between the data lines DL may be compensated (e.g., efficiently compensated), and thus display apparatus 10 may have a relatively improved (e.g., higher) image quality and a relatively improved (e.g., higher) performance.

Figure 3:
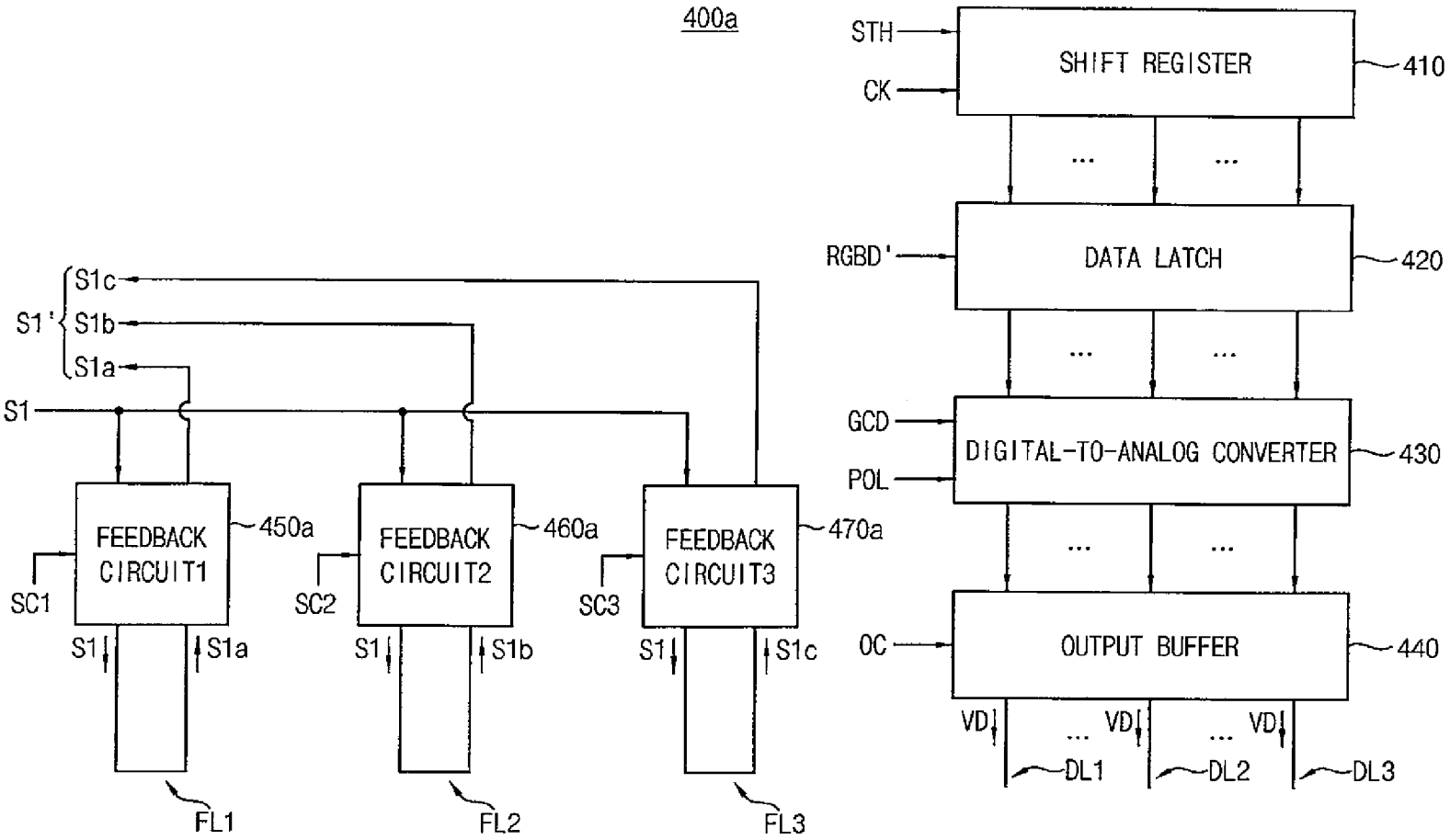
FIG. 3 is a block diagram illustrating a data driver included in the display apparatus of FIG. 1.

FIG. 3 is a block diagram illustrating a data driver included in the display apparatus of FIG. 1.

Referring to FIG. 3, a data driver 400*a* may include a shift register 410, a data latch 420, a digital-to-analog converter 430, an output buffer 440, a first feedback circuit 450*a*, a second feedback circuit 460*a* and a third feedback circuit 470*a*.

The shift register 410 may generate latch control signals based on a horizontal start signal STH and a data clock signal DCK. The horizontal start signal STH and the data clock signal DCK may be included in the second control signal CONT2 that is provided from the timing controller 200 in FIG. 1.

The data latch 420 may store the output image data RGBD' based on the latch control signals. The output image data RGBD' may be sequentially stored in the data latch 420 based on the latch control signals. The data latch 420 may output the output image data RGBD' based on a data load signal. The output image data RGBD' may be sequentially or concurrently (e.g., simultaneously) output from the data latch 420 based on the data load signal. The data load signal may be included in the second control signal CONT2 in FIG. 1.

The digital-to-analog converter 430 may generate the plurality of data voltages VD based on the output image data RGBD', gamma compensation data GCD and a polarity control signal POL. Each data voltage may have a positive polarity or a negative polarity. Data voltages with the positive polarity may have levels higher than that of the common voltage. Data voltages with the negative polarity may have levels lower than that of the common voltage. The polarity control signal POL may be included in the second control signal CONT2 in FIG. 1. The gamma compensation data GCD may be stored inside or outside the data driver 400*a* as a lookup table.

The output buffer 440 may output the plurality of data voltages VD to the plurality of data lines DL1, DL2 and DL3 based on an output control signal OC. The output control signal OC may be included in the second control signal CONT2 in FIG. 1.

The first feedback circuit 450*a* may be connected to the first end of the first feedback line FL1 and to the second end of the first feedback line FL1. The first feedback circuit 450*a* may apply the first signal S1 to the first end of the first feedback line FL1 and may provide a delayed first signal S1*a* output from the second end of the first feedback line FL1 to the timing controller 200 in FIG. 1. As will be further described below with reference to FIG. 4, the first feedback circuit 450*a* may operate based on a first switch control signal SC1.

The second feedback circuit 460*a* may be connected to the first end of the second feedback line FL2 and to the second end of the second feedback line FL2. The second feedback circuit 460*a* may apply the first signal S1 to the first end of the second feedback line FL2 and may provide a delayed first signal S1*b* output from the second end of the second feedback line FL2 to the timing controller 200 in FIG. 1. The second feedback circuit 460*a* may operate based on a second switch control signal SC2.

The third feedback circuit 470*a* may be connected to the first end of the third feedback line FL3 and to the second end of the third feedback line FL3. The third feedback circuit 470*a* may apply the first signal S1 to the first end of the third feedback line FL3 and may provide a delayed first signal S1*c* output from the second end of the third feedback line FL3 to the timing controller 200 in FIG. 1. The third feedback circuit 470*a* may operate based on a third switch control signal SC3.

In some example embodiments, the timing controller 200 in FIG. 1 may receive the delayed first signals S1*a*, S1*b* and S1*c* from the first, second, and third feedback circuits 450*a*, 460*a* and 470*a*. The timing controller 200 in FIG. 1 may obtain the first, second, and third delays associated with the first, second, and third data lines DL1, DL2 and DL3 based on the delayed first signals S1*a*, S1*b* and S1*c* (e.g., by measuring time until a particular pattern (e.g., a predetermined pattern) is detected from the delayed first signals S1*a*, S1*b* and S1*c*). The timing controller 200 in FIG. 1 may obtain the delays other than the first, second, and third delays associated with the data lines other than the first, second, and third data lines DL1, DL2 and DL3 by performing an interpolation operation based on the first, second, and third delays. The timing controller 200 in FIG. 1 may store the delays and may generate the output control signal SC based on the delays. The output buffer 440 included in the data driver 400*a* may control the outputs of the data voltages VD based on the output control signal OC, and thus the delays may be compensated (e.g., efficiently compensated). In other words, the transmission delay due to the length differences between the data lines DL may be compensated (e.g., efficiently compensated).

In some example embodiments, the first signal S1 may be sequentially applied to the feedback circuits 450*a*, 460*a* and 470*a* and the feedback lines FL1, FL2 and FL3. In other words, the operation of detecting the delays may be sequentially performed from the first feedback line FL1 to the third feedback line FL3. In other example embodiments, the first signal S1 may be concurrently (e.g., simultaneously) applied to the feedback circuits 450*a*, 460*a* and 470*a* and the feedback lines FL1, FL2 and FL3. In other words, the operation of detecting the delays may be concurrently (e.g., simultaneously) performed for all of the feedback lines FL1, FL2 and FL3.

The number of the feedback circuits included in the data driver 400*a* may be substantially the same as the number of the feedback lines included in the display apparatus 10. For example, although FIG. 3 illustrates an example where the data driver 400*a* includes three feedback circuits 450*a*, 460*a* and 470*a*, the number of the feedback circuits may not be limited thereto, but may be changed depending on the number of the feedback lines.

Figure 4:
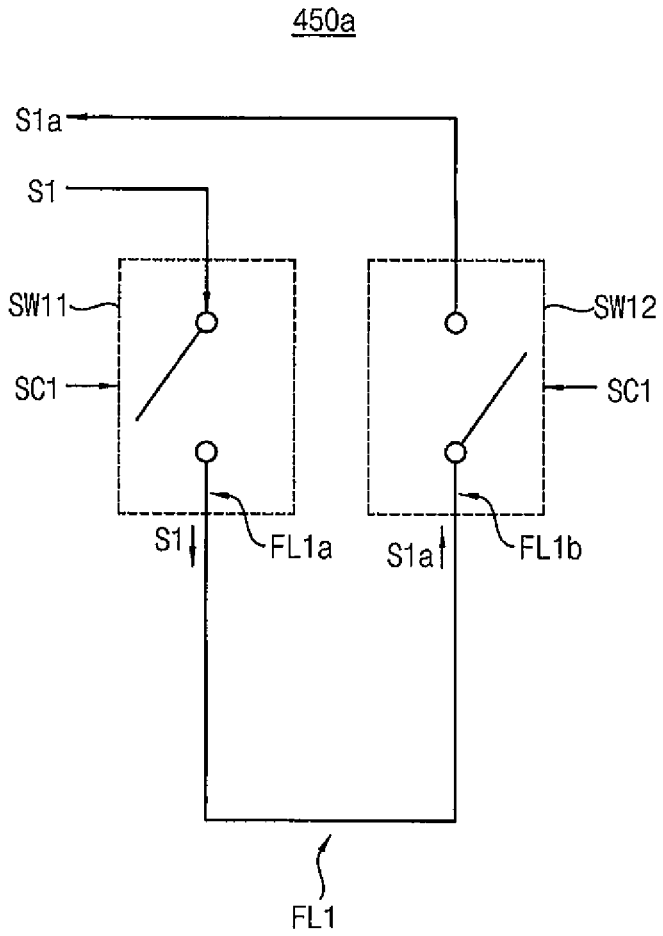
FIG. 4 is a diagram illustrating an example of a first feedback circuit included in the data driver of FIG. 3.

FIG. 4 is a diagram illustrating an example of a first feedback circuit included in the data driver of FIG. 3.

Referring to FIG. 4, the first feedback circuit 450*a* may include a first switch SW11 and a second switch SW12.

The first switch SW11 may selectively apply the first signal S1 to a first end FL1*a* of the first feedback line FL1 based on the first switch control signal SC1. For example, when the first switch control signal SC1 is activated, the first signal S1 may be applied to the first end FL1*a* of the first feedback line FL1 by the first switch SW11. The first switch control signal SC1 may be activated while the display apparatus 10 in FIG. 1 receives the boot-up command from the external host to perform the boot-up operation.

The second switch SW12 may selectively provide the delayed first signal S1*a* output from a second end FL1*b* of the first feedback line FL1 to the timing controller 200 in FIG. 1 based on the first switch control signal SC1. For example, when the first switch control signal SC1 is activated, the delayed first signal S1*a* may be provided to the timing controller 200 in FIG. 1 by the second switch SW12.

Each of the second feedback circuit 460*a* and the third feedback circuit 470*a* in FIG. 3 may have a structure substantially the same as that of the first feedback circuit 450*a* of FIG. 4.

Figure 5:
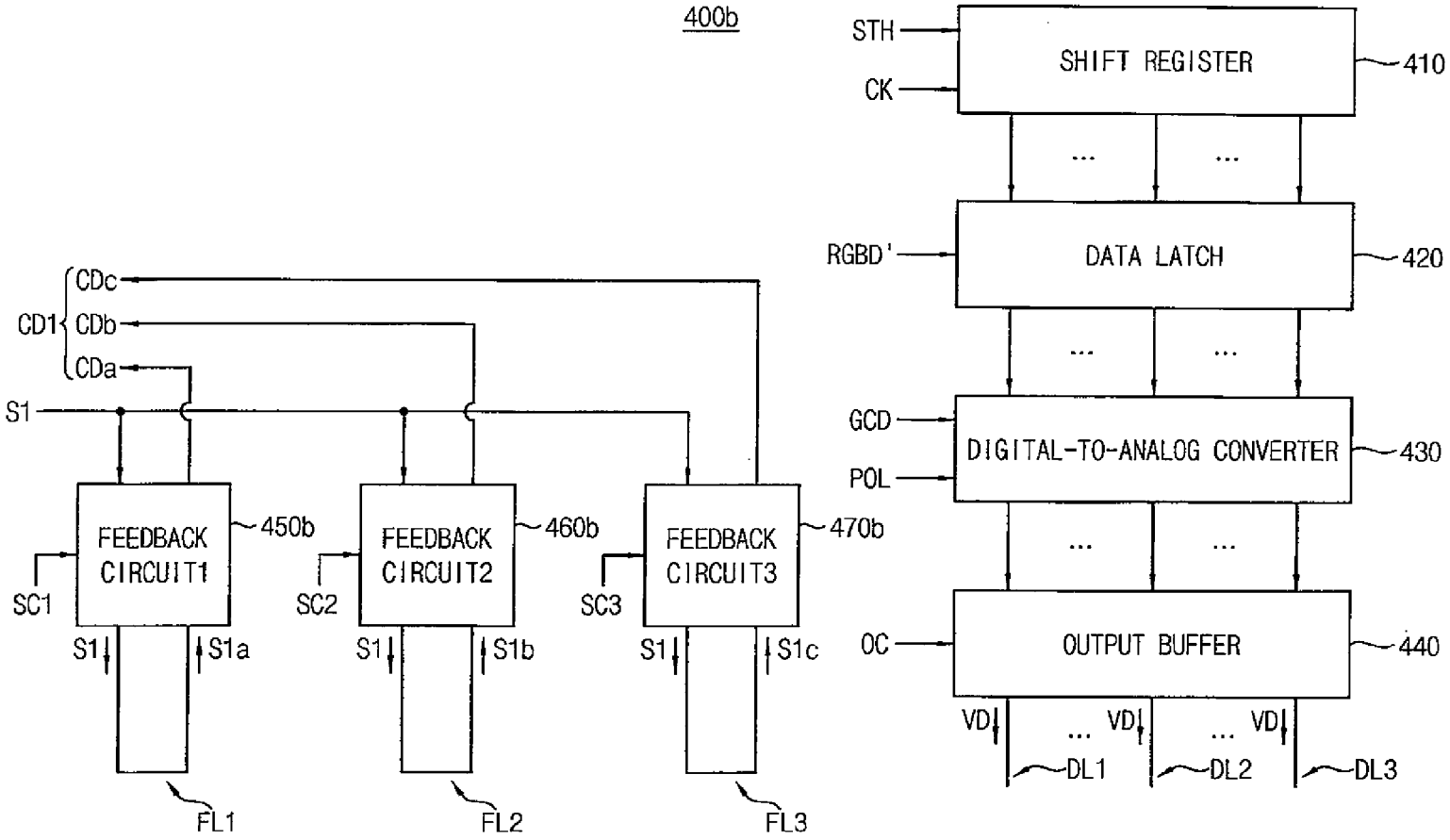
FIG. 5 is a block diagram illustrating a data driver included in the display apparatus of FIG. 1.

FIG. 5 is a block diagram illustrating a data driver included in the display apparatus of FIG. 1.

Referring to FIG. 5, a data driver 400*b* may include a shift register 410, a data latch 420, a digital-to-analog converter 430, an output buffer 440, a first feedback circuit 450*b*, a second feedback circuit 460*b* and a third feedback circuit 470*b*.

The shift register 410, the data latch 420, the digital-to-analog converter 430 and the output buffer 440 in FIG. 5 may be substantially the same as the shift register 410, the data latch 420, the digital-to-analog converter 430 and the output buffer 440 in FIG. 3, respectively.

The first feedback circuit 450*b* may be connected to the first end of the first feedback line FL1 and to the second end of the first feedback line FL1. The first feedback circuit 450*b* may apply the first signal S1 to the first end of the first feedback line FL1 and may obtain the first delay associated with the first data line DL1 based on a delayed first signal S1*a* output from the second end of the first feedback line FL1. The first feedback circuit 450*b* may generate a first count signal CDa corresponding to the first delay to provide the first count signal CDa to the timing controller 200 in FIG. 1. As will be further described below with reference to FIG. 6, the first feedback circuit 450*b* may operate based on a first switch control signal SC1.

The second feedback circuit 460*b* may be connected to the first end of the second feedback line FL2 and to the second end of the second feedback line FL2. The second feedback circuit 460*b* may apply the first signal S1 to the first end of the second feedback line FL2 and may obtain the second delay associated with the second data line DL2 based on a delayed first signal S1*b* output from the second end of the second feedback line FL2. The second feedback circuit 460*b* may generate a second count signal CDb corresponding to the second delay to provide the second count signal CDb to the timing controller 200 in FIG. 1. The second feedback circuit 460*b* may operate based on a second switch control signal SC2.

The third feedback circuit 470*b* may be connected to the first end of the third feedback line FL3 and to the second end of the third feedback line FL3. The third feedback circuit 470*b* may apply the first signal S1 to the first end of the third feedback line FL3 and may obtain the third delay associated with the third data line DL3 based on a delayed first signal S1*c* output from the second end of the third feedback line FL3. The third feedback circuit 470*b* may generate a third count signal CDc corresponding to the third delay to provide the third count signal CDc to the timing controller 200 in FIG. 1. The third feedback circuit 470*b* may operate based on a third switch control signal SC3.

In some example embodiments, the timing controller 200 in FIG. 1 may receive the count signals CDa, CDb and CDc from the first, second, and third feedback circuits 450*b*, 460*b* and 470*b*, respectively. The timing controller 200 in FIG. 1 may obtain the first, second, and third delays associated with the first, second, and third data lines DL1, DL2 and DL3 based on the count signals CDa, CDb and CDc. The timing controller 200 in FIG. 1 may obtain the delays other than the first, second, and third delays associated with the data lines other than the first, second, and third data lines DL1, DL2 and DL3 by performing the interpolation operation based on the first, second, and third delays. The timing controller 200 in FIG. 1 may store the delays and may generate the output control signal SC based on the delays. The output buffer 440 included in the data driver 400*b* may control the outputs of the data voltages VD based on the output control signal SC, and thus the delays may be compensated (e.g., efficiently compensated). In other words, the transmission delay due to the length differences between the data lines DL may be compensated (e.g., efficiently compensated).

In some example embodiments, the count signals CDa, CDb and CDc may be analog signals. For example, when the data driver 400*b* outputs 8-bit analog voltages, 3-bit analog voltages may be assigned for the first count signal CDa, other 3-bit analog voltages may be assigned for the third count signal CDc, and 2-bit analog voltages may be assigned for the second count signal CDb. In this case, the first count signal CDa may have a first count value for the first delay, and the third count signal CDc may have a third count value for the third delay. The second count signal CDb may have a value that corresponds to a difference between the first count value and a second count value for the second delay or a difference between the third count value and the second count value. The data driver 400*b* may further include a multiplexer for combining the analog count signals CDa, CDb and CDc, and the timing controller 200 in FIG. 1 may include an analog-to-digital converter for receiving the combined analog count signals CDa, CDb and CDc.

In some example embodiments, the first signal S1 may be sequentially applied to the feedback circuits 450*b*, 460*b* and 470*b* and the feedback lines FL1, FL2 and FL3. In other example embodiments, the first signal S1 may be concurrently (e.g., simultaneously) applied to the feedback circuits 450*b*, 460*b* and 470*b*. The number of the feedback circuits included in the data driver 400*b* may be substantially the same as the number of the feedback lines included in the display apparatus 10.

Figure 6:
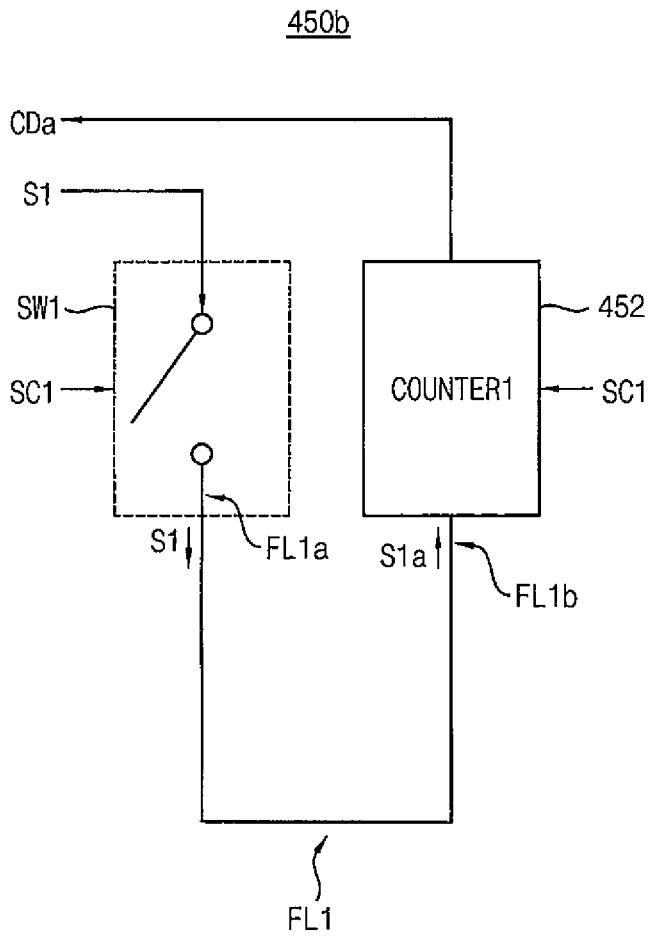
FIG. 6 is a diagram illustrating an example of a first feedback circuit included in the data driver of FIG. 5.

FIG. 6 is a diagram illustrating an example of a first feedback circuit included in the data driver of FIG. 5.

Referring to FIG. 6, the first feedback circuit 450*b* may include a first switch SW1 and a first counter 452.

The first switch SW1 may selectively apply the first signal S1 to a first end FL1*a* of the first feedback line FL1 based on the first switch control signal SC1. The first switch SW1 in FIG. 6 may be substantially the same as the first switch SW11 in FIG. 4.

The first counter 452 may obtain the first delay by counting a time interval between a first time at which the first signal S1 is applied to the first end FL1*a* of the first feedback line FL1 and a second time at which the delayed first signal S1*a* is output from a second end FL1*b* of the first feedback line FL1. The first counter 452 may provide the first count signal CDa corresponding to the first delay to the timing controller 200 in FIG. 1. For example, when the first switch control signal SC1 is activated, the first counter 452 may start to perform a counting operation. When a particular pattern (e.g., the predetermined pattern, such as a test pattern or a clock waveform) is detected from the delayed first signal S1*a*, the first counter 452 may terminate the counting operation to generate the first count signal CDa.

Each of the second feedback circuit 460*b* and the third feedback circuit 470*b* in FIG. 5 may have a structure substantially the same as that of the first feedback circuit 450*b* of FIG. 6.

Figure 7:
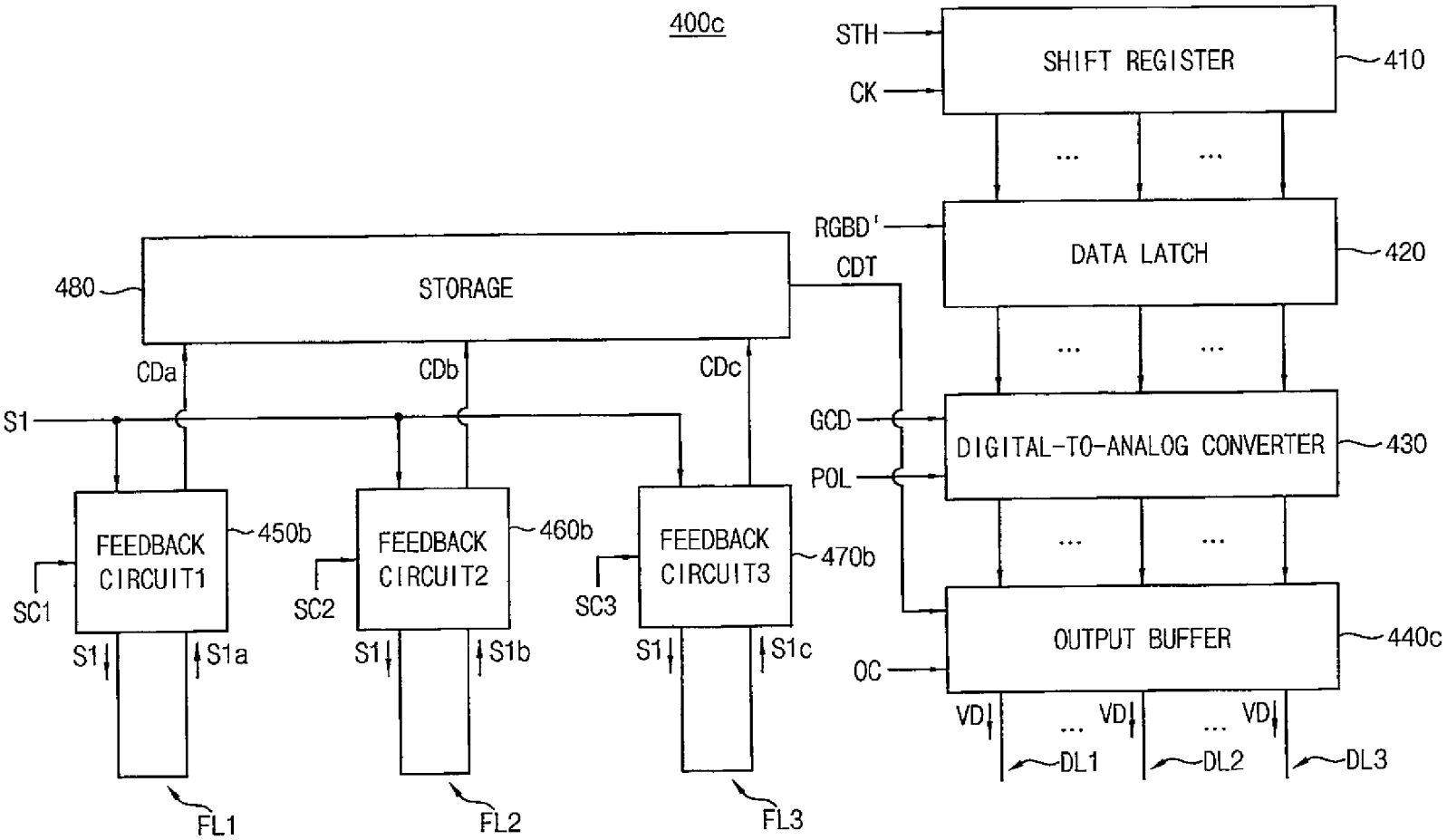
FIG. 7 is a block diagram illustrating a data driver included in the display apparatus of FIG. 1.

FIG. 7 is a block diagram illustrating a data driver included in the display apparatus of FIG. 1.

Referring to FIG. 7, a data driver 400*c* may include a shift register 410, a data latch 420, a digital-to-analog converter 430, an output buffer 440*c*, a first feedback circuit 450*b*, a second feedback circuit 460*b* and a third feedback circuit 470*b*. The data driver 400*c* may further include a storage 480.

The shift register 410, the data latch 420, the digital-to-analog converter 430, the first feedback circuit 450*b*, the second feedback circuit 460*b* and the third feedback circuit 470*b* in FIG. 7 may be substantially the same as the shift register 410, the data latch 420, the digital-to-analog converter 430, the first feedback circuit 450*b*, the second feedback circuit 460*b* and the third feedback circuit 470*b* in FIG. 5, respectively.

The storage 480 may store the first delay, the second delay and the third delay based on the count signals CDa, CDb and CDc that are received from the feedback circuits 450*b*, 460*b* and 470*b*, respectively. In addition, the storage 480 may store delays other than the first, second, and third delays, which may be obtained by performing an interpolation operation based on the first, second, and third delays. The storage 480 may generate a delay control signal CDT corresponding to the delays associated with total data lines DL.

The output buffer 440*c* may output the plurality of data voltages VD to the plurality of data lines DL1, DL2 and DL3 based on an output control signal OC and the delay control signal CDT. The output buffer 440*c* included in the data driver 400*c* may control the outputs of the data voltages VD based on the delay control signal CDT, and thus, the delays may be compensated (e.g., efficiently compensated). In other words, the transmission delay due to the length differences between the data lines DL may be compensated (e.g., efficiently compensated).

The data driver 400*c* of FIG. 7 may not provide the delayed first signal S1' or the count signal CD1 to the timing controller 200 in FIG. 1.

Figure 8:
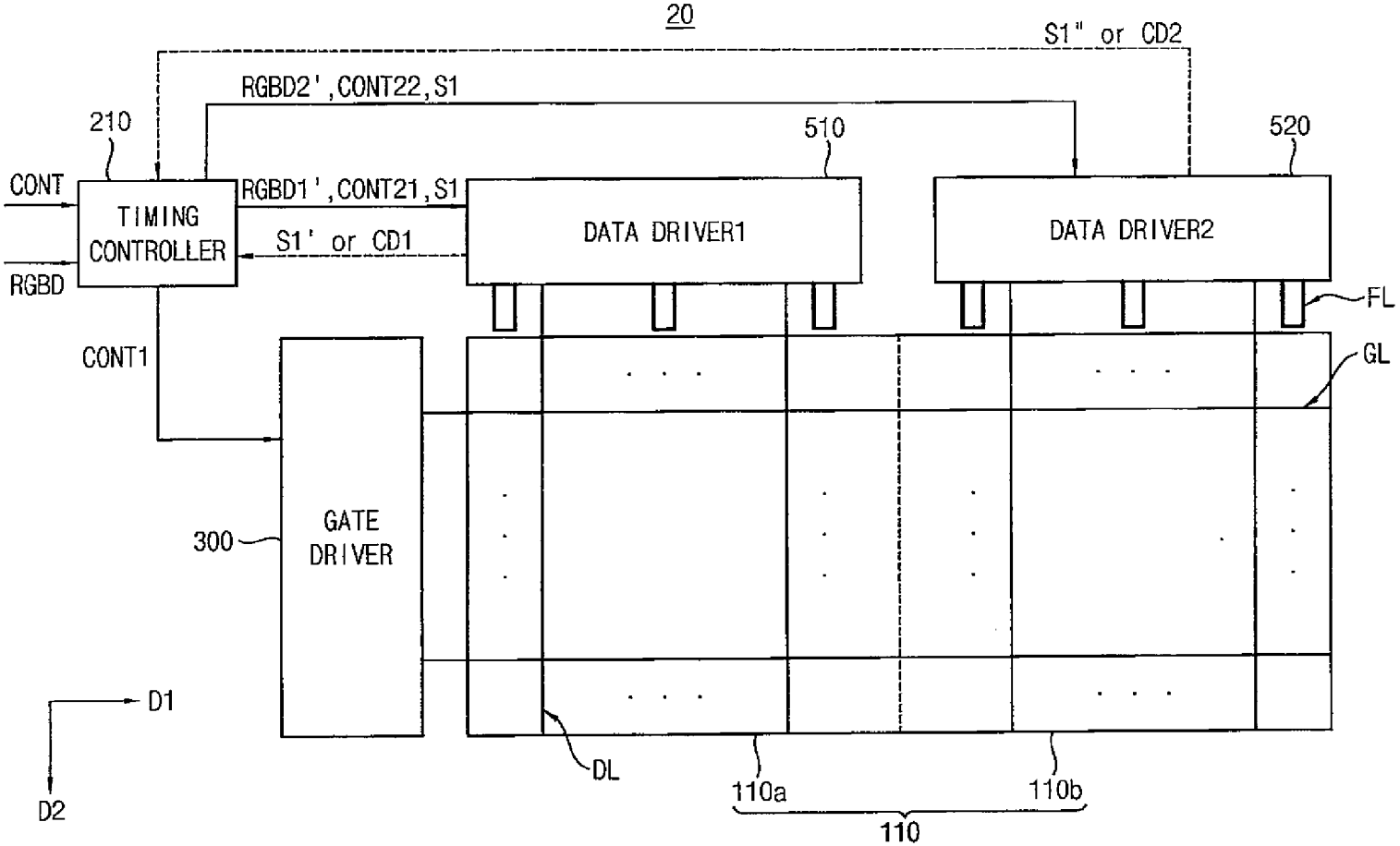
FIG. 8 is a block diagram illustrating a display apparatus according to some example embodiments.

FIG. 8 is a block diagram illustrating a display apparatus according to some example embodiments.

Referring to FIG. 8, a display apparatus 20 includes a display panel 110, a timing controller 210, a gate driver 300, a first data driver 510, a second data driver 520 and a plurality of feedback lines FL.

The display panel 110 is connected to a plurality of gate lines GL and a plurality of data lines DL. The display panel 110 displays an image having a plurality of grayscale levels based on output image data RGBD1' and RGBD2'. The display panel 110 is divided into a first display area 110*a* and a second display area 110*b*. The display panel 110 in FIG. 8 may be substantially the same as the display panel 100 in FIG. 1, except that the display panel 110 in FIG. 8 is divided into two display areas 110*a* and 110*b*.

The timing controller 210 controls an operation of the display panel 110 and controls operations of the gate driver 300 and the data drivers 510 and 520. The timing controller 210 generates the output image data RGBD1' and RGBD2', a first control signal CONT1, second control signals CONT21 and CONT22, and a first signal S1 based on input image data RGBD and an input control signal CONT.

For example, the timing controller 210 may generate the output image data RGBD1' and RGBD2' based on the input image data RGBD. The output image data RGBD1' may be provided to the first data driver 510, and the output image data RGBD2' may be provided to the second data driver 520. The timing controller 210 may generate the first control signal CONT1 based on the input control signal CONT. The first control signal CONT1 may be provided to the gate driver 300. The timing controller 210 may generate the second control signals CONT21 and CONT22 based on the input control signal CONT. The second control signal CONT21 may be provided to the first data driver 510, and the second control signal CONT22 may be provided to the second data driver 520.

In addition, the timing controller 210 generates the first signal S1 based on the input control signal CONT. The first signal S1 may be provided to the data drivers 510 and 520.

The plurality of feedback lines FL are located in a fan-out region between the display panel 110 and the data drivers 510 and 520.

The gate driver 300 generates a plurality of gate signals for driving the gate lines GL based on the first control signal CONT1. The gate driver 300 may sequentially apply the plurality of gate signals to the gate lines GL.

The first data driver 510 generates a plurality of first data voltages (e.g., analog data voltages) based on the second control signal CONT21 and the output image data RGBD1' (e.g., digital image data). The first data driver 510 may apply the plurality of first data voltages to a first group of data lines among the plurality of data lines DL. The first group of data lines is located in the first display area 110*a*.

The second data driver 520 generates a plurality of second data voltages (e.g., analog data voltages) based on the second control signal CONT22 and the output image data RGBD2' (e.g., digital image data). The second data driver 520 may apply the plurality of second data voltages to a second group of data lines among the plurality of data lines DL. The second group of data lines is located in the second display area 110*b*.

In addition, the data drivers 510 and 520 apply the first signal S1 to each of the plurality of feedback lines FL. The delays by the fan-out region are obtained based on the first signal S1. The data drivers 510 and 520 control outputs (e.g., driving times) of the plurality of first and second data voltages based on the delays. The data drivers 510 and 520 may provide delayed first signals S1' and S1" that are delayed (e.g., lagged) by passing through each of the plurality of feedback lines FL to the timing controller 210 or may provide count signals CD1 and CD2 corresponding to the delays of the timing controller 210.

In some example embodiments, the delays may be obtained while the display apparatus 20 receives a boot-up command from an external host to perform a boot-up operation.

Figure 9:
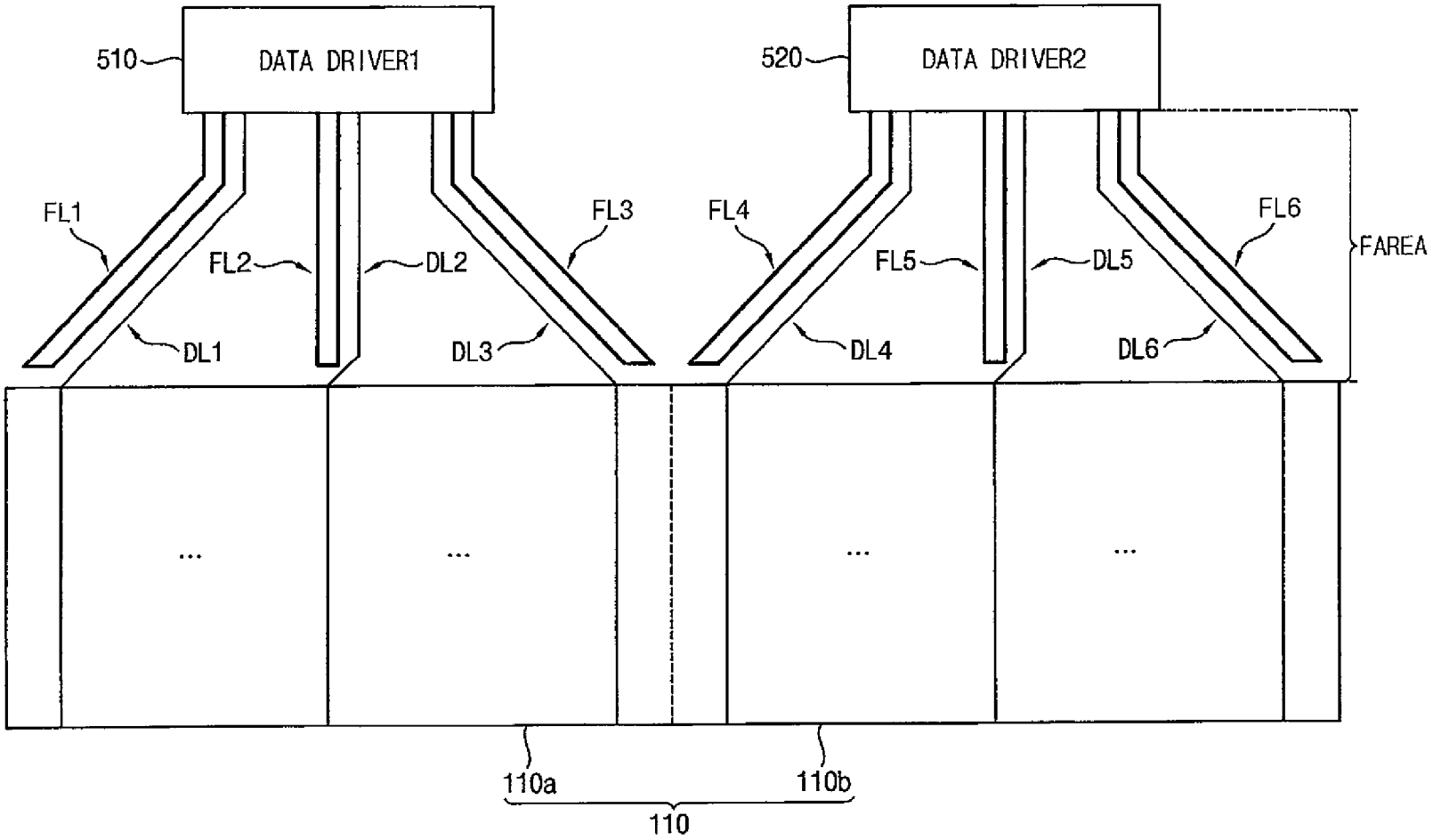
FIG. 9 is a diagram for describing an arrangement of a plurality of feedback lines included in the display apparatus of FIG. 8.

FIG. 9 is a diagram for describing an arrangement of a plurality of feedback lines included in the display apparatus of FIG. 8.

Referring to FIGS. 8 and 9, the plurality of feedback lines FL may be located in a fan-out region FAREA and may be separated from the plurality of data lines DL. The fan-out region FAREA may be defined as a region where lines (e.g., the first group of data lines) are located between the display panel 110 and the first data driver 510 and a region where lines (e.g., the second group of data lines) are located between the display panel 110 and the second data driver 520.

The plurality of data lines DL may include a first data line DL1, a second data line DL2, and a third data line DL3. The first, second, and third data lines DL1, DL2 and DL3 may be included in the first group of the data lines. The first data line DL1 may be located in a first edge region of the first display area 110*a*. The second data line DL2 may be located in a central region of the first display area 110*a*. The third data line DL3 may be located in a second edge region of the first display area 110*a* opposite to the first edge region of the first display area 110*a*.

The plurality of feedback lines FL may include a first feedback line FL1, a second feedback line FL2 and a third feedback line FL3. The first feedback line FL1 may be located in the fan-out region FAREA and may be located adjacent to the first data line DL1. The second feedback line FL2 may be located in the fan-out region FAREA and may be located adjacent to the second data line DL2. The third feedback line FL3 may be located in the fan-out region FAREA and may be located adjacent to the third data line DL3.

The plurality of data lines DL may further include a fourth data line DL4, a fifth data line DL5 and a sixth data line DL6. The fourth, fifth, and sixth data lines DL4, DL5 and DL6 may be included in the second group of the data lines. The fourth data line DL4 may be located in a third edge region of the second display area 110*b*. The fifth data line DL5 may be located in a central region of the second display area 110*b*. The sixth data line DL6 may be located in a fourth edge region of the second display area 110*b* opposite to the third edge region of the second display area 110*b*.

The plurality of feedback lines FL may further include a fourth feedback line FL4, a fifth feedback line FL5 and a sixth feedback line FL6. The fourth feedback line FL4 may be located in the fan-out region FAREA and may be located adjacent to the fourth data line DL4. The fifth feedback line FL5 may be located in the fan-out region FAREA and may be located adjacent to the fifth data line DL5. The sixth feedback line FL6 may be located in the fan-out region FAREA and may be located adjacent to the sixth data line DL6.

In some example embodiments, each feedback line may have a first end receiving the first signal S1 and a second end outputting one of the delayed first signals S1' and S1". The delayed first signals S1' and S1" may be delayed (e.g., lagged) by passing through each feedback line. For example, a first delay associated with the first data line DL1 may be obtained based on the first signal S1 applied to the first feedback line FL1, a second delay associated with the second data line DL2 may be obtained based on the first signal S1 applied to the second feedback line FL2, and a third delay associated with the third data line DL3 may be obtained based on the first signal S1 applied to the third feedback line FL3. Delays other than the first, second, and third delays may be obtained by performing an interpolation operation based on the first, second, and third delays.

Similarly, a fourth delay associated with the fourth data line DL4 may be obtained based on the first signal S1 applied to the fourth feedback line FL4, a fifth delay associated with the fifth data line DL5 may be obtained based on the first signal S1 applied to the fifth feedback line FL5, and a sixth delay associated with the sixth data line DL6 may be obtained based on the first signal S1 applied to the sixth feedback line FL6. Delays other than the fourth, fifth, and sixth delays may be obtained by performing the interpolation operation based on the fourth, fifth, and sixth delays.

The plurality of feedback lines FL and the plurality of data lines DL may be formed on the same layer. Each of the data drivers 510 and 520 may have a structure substantially the same as that of one of the data driver 400*a* of FIG. 3, the data driver 400*b* of FIG. 5 and the data driver 400*c* of FIG. 7. For example, each of the data drivers 510 and 520 may include a first feedback circuit, a second feedback circuit and a third feedback circuit, and each feedback circuit may have a structure substantially the same as that of one of the feedback circuit 450*a* of FIG. 4 and the feedback circuit 450*b* of FIG. 6.

In some example embodiments, the operation of detecting the delays may be sequentially performed from the first feedback line FL1 to the sixth feedback line FL6. In other example embodiments, the operation of detecting the delays may be concurrently (e.g., simultaneously) performed for all of the feedback lines FL1~FL6.

Although FIGS. 8 and 9 illustrates an example where the display panel 110 is divided into two display areas 110*a* and 110*b* and where the display apparatus 20 includes two data drivers 510 and 520, the number of the display areas and the data drivers in the display apparatus may not be limited thereto, but may be changed. In addition, the number of the feedback lines in the display apparatus may not be limited thereto, but may be changed.

Figure 10:
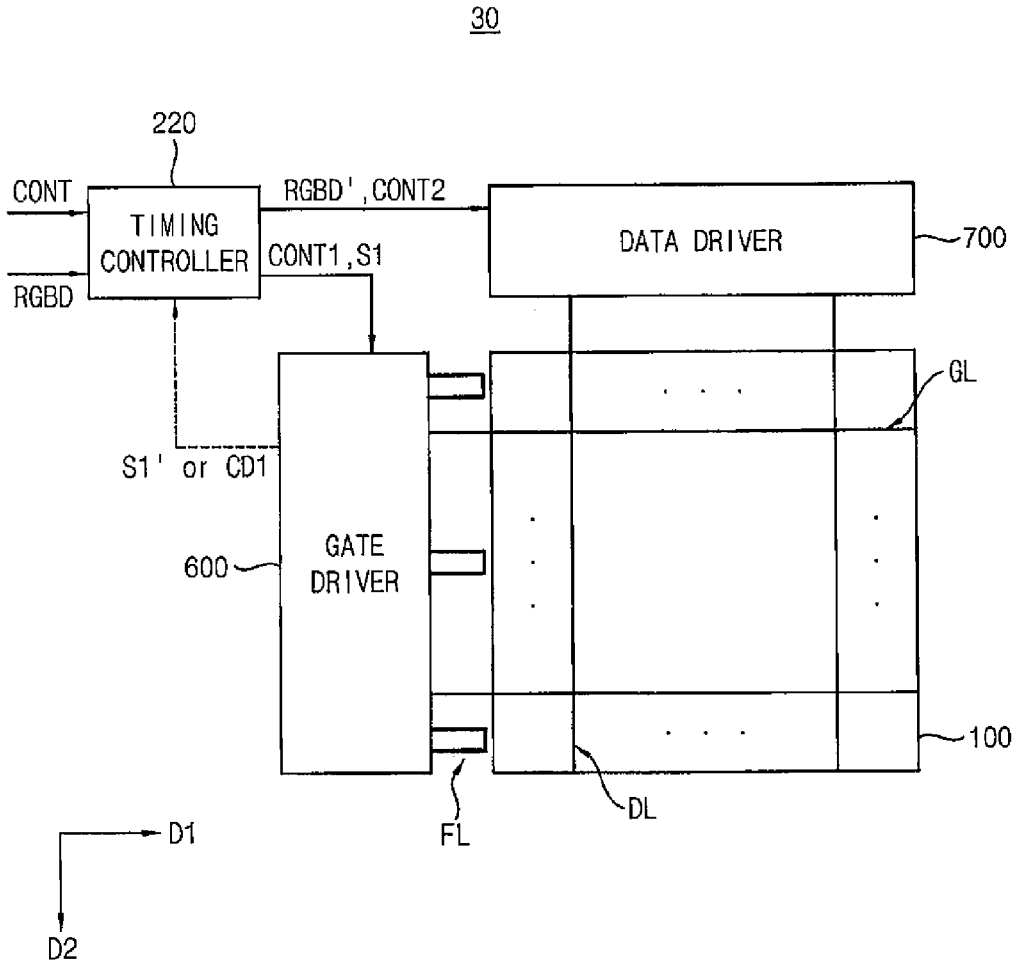
FIG. 10 is a block diagram illustrating a display apparatus according to some example embodiments.

FIG. 10 is a block diagram illustrating a display apparatus according to some example embodiments.

Referring to FIG. 10, a display apparatus 30 includes a display panel 100, a timing controller 220, a gate driver 600, a data driver 700 and a plurality of feedback lines FL.

The display panel 100 is connected to a plurality of gate lines GL and a plurality of data lines DL. The display panel 100 displays an image having a plurality of grayscale levels based on output image data RGBD'. The display panel 100 in FIG. 10 may be substantially the same as the display panel 100 in FIG. 1.

The timing controller 220 controls an operation of the display panel 100 and controls operations of the gate driver 600 and the data driver 700. The timing controller 220 generates the output image data RGBD', a first control signal CONT1, a second control signal CONT2 and a first signal S1 based on input image data RGBD and an input control signal CONT.

For example, the timing controller 220 may generate the output image data RGBD' based on the input image data RGBD. The output image data RGBD' may be provided to the data driver 700. The timing controller 220 may generate the first control signal CONT1 based on the input control signal CONT. The first control signal CONT1 may be provided to the gate driver 600. The timing controller 220 may generate the second control signal CONT2 based on the input control signal CONT. The second control signal CONT2 may be provided to the data driver 700.

In addition, the timing controller 220 generates the first signal S1 based on the input control signal CONT. The first signal S1 may be provided to the data driver 700.

The plurality of feedback lines FL are located in a fan-out region between the display panel 100 and the gate driver 600.

The gate driver 600 generates a plurality of gate signals for driving the gate lines GL based on the first control signal CONT1. The gate driver 600 may sequentially apply the plurality of gate signals to the gate lines GL.

In addition, the gate driver 600 applies the first signal S1 to each of the plurality of feedback lines FL. The delays by the fan-out region are obtained based on the first signal S1. The gate driver 600 controls outputs (e.g., driving times) of the plurality of gate signals based on the delays. The gate driver 600 may provide a delayed first signal S1' that is delayed (e.g., lagged) by passing through each of the plurality of feedback lines FL to the timing controller 220 or may provide a count signal CD1 corresponding to the delays to the timing controller 220.

The data driver 700 generates a plurality of data voltages (e.g., analog data voltages) based on the second control signal CONT2 and the output image data RGBD' (e.g., digital image data). The data driver 700 may apply the plurality of data voltages to the plurality of data lines DL. The data driver 700 may include a shift register, a data latch, a digital-to-analog converter, and an output buffer.

Figure 11:
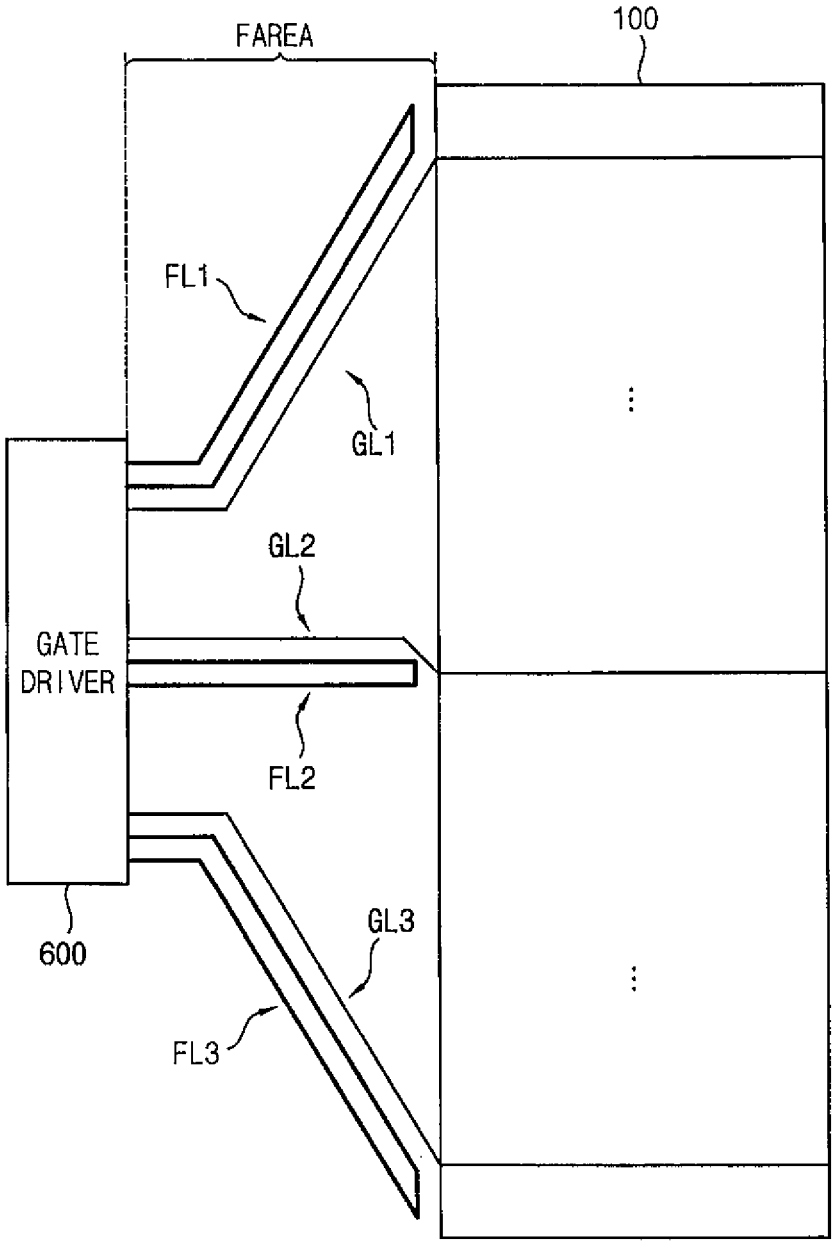
FIG. 11 is a diagram for describing an arrangement of a plurality of feedback lines included in the display apparatus of FIG. 10.

FIG. 11 is a diagram for describing an arrangement of a plurality of feedback lines included in the display apparatus of FIG. 10.

Referring to FIGS. 10 and 11, the plurality of feedback lines FL may be located in a fan-out region FAREA and may be separated from the plurality of gate lines GL. The fan-out region FAREA may be defined as a region where lines (e.g., the gate lines) are located between the display panel 100 and the gate driver 600.

The plurality of gate lines GL may include a first gate line GL1, a second gate line GL2 and a third gate line GL3. The first gate line GL1 may be located in a first edge region of the display panel 100. The second gate line GL2 may be located in a central region of the display panel 100. The third gate line GL3 may be located in a second edge region of the display panel 100 opposite to the first edge region of the display panel 100.

The plurality of feedback lines FL may include a first feedback line FL1, a second feedback line FL2 and a third feedback line FL3. The first feedback line FL1 may be located in the fan-out region FAREA and may be located adjacent to the first gate line GL1. The second feedback line FL2 may be located in the fan-out region FAREA and may be located adjacent to the second gate line GL2. The third feedback line FL3 may be located in the fan-out region FAREA and may be located adjacent to the third gate line GL3.

In some example embodiments, each feedback line may have a first end receiving the first signal S1 and a second end outputting the delayed first signal S1'. The delayed first signal S1' may be delayed (e.g., lagged) by passing through each feedback line. For example, a first delay associated with the first gate line GL1 may be obtained based on the first signal S1 applied to the first feedback line FL1, a second delay associated with the second gate line GL2 may be obtained based on the first signal S1 applied to the second feedback line FL2, and a third delay associated with the third gate line GL3 may be obtained based on the first signal S1 applied to the third feedback line FL3. Delays other than the first, second, and third delays may be obtained by performing an interpolation operation based on the first, second, and third delays.

The plurality of feedback lines FL and the plurality of gate lines GL may be formed on the same layer. The gate driver 600 may have a structure similar to that of one of the data driver 400*a* of FIG. 3, the data driver 400*b* of FIG. 5 and the data driver 400*c* of FIG. 7. For example, the gate driver 600 may include a first feedback circuit, a second feedback circuit and a third feedback circuit, and each feedback circuit may have a structure substantially the same as that of one of the feedback circuit 450*a* of FIG. 4 and the feedback circuit 450*b* of FIG. 6.

In some example embodiments, the operation of detecting the delays may be sequentially performed from the first feedback line FL1 to the third feedback line FL3. In other example embodiments, the operation of detecting the delays may be concurrently (e.g., simultaneously) performed for all of the feedback lines FL1~FL3.

In some example embodiments, the display panel may be divided into at least two display areas, and the display apparatus may include at least two gate drivers. In some example embodiments, the number of the feedback lines in the display apparatus may not be limited thereto, but may be changed.

The display apparatus 30, according to some example embodiments, may include the plurality of feedback lines FL that are located in the fan-out region FAREA and are separated from the plurality of gate lines GL. The outputs (e.g., driving times) of the plurality of gate signals may be controlled based on the delays that are detected and obtained based on the plurality of feedback lines FL. Accordingly, transmission delay due to length differences between the gate lines GL may be compensated (e.g., efficiently compensated), and thus display apparatus 30 may have a relatively improved (e.g., higher) image quality and a relatively improved (e.g., higher) performance.

The above described embodiments may be used in a display apparatus and/or a system including the display apparatus, such as a mobile phone, a smart phone, a PDA, a PMP, a digital camera, a digital television, a set-top box, a music player, a portable game console, a navigation device, a personal computer (PC), a server computer, a workstation, a tablet computer, a laptop computer, a smart card, a printer, etc.

The foregoing is illustrative of example embodiments and is not to be construed as limiting thereof. Although a number of example embodiments have been described, those skilled in the art will readily appreciate that many suitable modifications are possible in the example embodiments without materially departing from the novel teachings and advantages of the present inventive concept. Accordingly, all such modifications are intended to be included within the scope of the present inventive concept as defined in the claims, and equivalents thereof. Therefore, it is to be understood that the foregoing is illustrative of various example embodiments and is not to be construed as limited to the specific example embodiments disclosed, and that modifications to the disclosed example embodiments, as well as other example embodiments, are intended to be included within the scope of the appended claims, and equivalents thereof.

What is claimed is:

1. A display apparatus comprising:

a display panel connected to a plurality of data lines;

a data driver configured to generate a plurality of data voltages, and to apply the plurality of data voltages to the plurality of data lines; and a plurality of feedback lines in a fan-out region between the display panel and the data driver, wherein the data driver is further configured to apply a first signal to each of the plurality of feedback lines, and to measure delays by the fan-out region based on a return time of the first signal, the delays being associated with the plurality of data lines, and wherein the data driver is further configured to control output times of the plurality of data voltages based on the measured delays.

2. The display apparatus of claim 1, wherein the plurality of feedback lines includes:

a first feedback line in the fan-out region and adjacent to a first data line among the plurality of data lines, the first data line being in a first edge region of the display panel;

a second feedback line in the fan-out region and adjacent to a second data line among the plurality of data lines, the second data line being in a central region of the display panel; and a third feedback line in the fan-out region and adjacent to a third data line among the plurality of data lines, the third data line being in a second edge region of the display panel opposite to the first edge region of the display panel.

3. The display apparatus of claim 2, wherein the first feedback line includes a first end configured to receive the first signal and a second end configured to output the first signal, and wherein a first delay associated with the first data line is obtained based on a time interval between a first time at which the first signal is applied to the first end of the first feedback line and a second time at which the first signal is output from the second end of the first feedback line.

4. The display apparatus of claim 2, wherein a first delay associated with the first data line is obtained based on the first signal applied to the first feedback line, a second delay associated with the second data line is obtained based on the first signal applied to the second feedback line, and a third delay associated with the third data line is obtained based on the first signal applied to the third feedback line, and wherein delays other than the first, second, and third delays are obtained by performing an interpolation operation based on the first, second, and third delays, the delays other than the first, second and third delays being associated with data lines other than the first, second, and third data lines.

5. The display apparatus of claim 2, wherein the data driver includes:

a first feedback circuit configured to apply the first signal to the first feedback line to traverse and be output from the first feedback line, and to provide the first signal output from the first feedback line to an external timing controller;

a second feedback circuit configured to apply the first signal to the second feedback line to traverse and be output from the second feedback line, and to provide the first signal output from the second feedback line to the external timing controller; and a third feedback circuit configured to apply the first signal to the third feedback line to traverse and be output from the third feedback line, and to provide the first signal output from the third feedback line to the external timing controller.

6. The display apparatus of claim 5, wherein the first feedback circuit includes:

a first switch configured to selectively apply the first signal to a first end of the first feedback line based on a first switch control signal, the applied first signal traversing and being output from a second end of the first feedback line; and a second switch configured to selectively provide the first signal output from the second end of the first feedback line to the external timing controller based on the first switch control signal.

7. The display apparatus of claim 2, wherein the data driver includes:

a first feedback circuit configured to apply the first signal to the first feedback line to traverse and be output from the first feedback line, and to obtain a first delay associated with the first data line based on the first signal output from the first feedback line;

a second feedback circuit configured to apply the first signal to the second feedback line to traverse and be output from the second feedback line, and to obtain a second delay associated with the second data line based on the first signal output from the second feedback line; and a third feedback circuit configured to apply the first signal to the third feedback line to traverse and be output from the third feedback line, and to obtain a third delay associated with the third data line based on the first signal output from the third feedback line.

8. The display apparatus of claim 7, wherein the first feedback circuit includes:

a first switch configured to selectively apply the first signal to a first end of the first feedback line based on a first switch control signal; and a first counter configured to obtain the first delay by counting a time interval between a first time at which the first signal is applied to the first end of the first feedback line and a second time at which the first signal is output from a second end of the first feedback line.

9. The display apparatus of claim 7, wherein the data driver further includes:

a storage configured to store the first delay, the second delay, and the third delay.

10. The display apparatus of claim 7, further comprising:

a timing controller configured to control an operation of the data driver, wherein the first delay, the second delay, and the third delay are stored in the timing controller.

11. The display apparatus of claim 1, wherein the delays are obtained while the display apparatus receives a boot-up command from an external host to perform a boot-up operation.

12. A display apparatus comprising:

a display panel connected to a plurality of data lines, the display panel being divided into a first display area and a second display area;

a first data driver configured to generate a plurality of first data voltages, and to apply the plurality of first data voltages to a first group of data lines among the plurality of data lines, the first group of data lines being in the first display area;

a second data driver configured to generate a plurality of second data voltages, and to apply the plurality of second data voltages to a second group of data lines among the plurality of data lines, the second group of data lines being in the second display area; and a plurality of feedback lines in a fan-out region between the display panel and the first and second data drivers, wherein the first and second data drivers are configured to apply a first signal to each of the plurality of feedback lines, and to measure delays by the fan-out region based on a return time of the first signal, the delays being associated with the plurality of data lines, and wherein the first and second data drivers are further configured to control output times of the plurality of first and second data voltages based on the measured delays.

13. The display apparatus of claim 12, wherein the plurality of feedback lines includes:

a first feedback line in the fan-out region and adjacent to a first data line among the first group of data lines, the first data line being in a first edge region of the first display area;

a second feedback line in the fan-out region and adjacent to a second data line among the first group of data lines, the second data line being in a central region of the first display area; and a third feedback line in the fan-out region and adjacent to a third data line among the first group of data lines, the third data line being in a second edge region of the first display area opposite to the first edge region of the first display area.

14. The display apparatus of claim 13, wherein the first feedback line includes a first end configured to receive the first signal and a second end configured to output the first signal, and wherein a first delay associated with the first data line is obtained based on a time interval between a first time at which the first signal is applied to the first end of the first feedback line and a second time at which the first signal is output from the second end of the first feedback line.

15. The display apparatus of claim 13, wherein a first delay associated with the first data line is obtained based on the first signal applied to the first feedback line, a second delay associated with the second data line is obtained based on the first signal applied to the second feedback line, and a third delay associated with the third data line is obtained based on the first signal applied to the third feedback line, and wherein delays other than the first, second, and third delays are obtained by performing an interpolation operation based on the first, second, and third delays, the delays other than the first, second, and third delays being associated with data lines other than the first, second, and third data lines.

16. The display apparatus of claim 13, wherein the data driver includes:

a first feedback circuit configured to apply the first signal to the first feedback line to traverse and be output from the first feedback line, and to provide the first signal output from the first feedback line to an external timing controller;

a second feedback circuit configured to apply the first signal to the second feedback line to traverse and be output from the second feedback line, and to provide the first signal output from the second feedback line to the external timing controller; and a third feedback circuit configured to apply the first signal to the third feedback line to traverse and be output from the third feedback line, and to provide the first signal output from the third feedback line to the external timing controller.

17. The display apparatus of claim 13, wherein the data driver includes:

a first feedback circuit configured to apply the first signal to the first feedback line to traverse and be output from the first feedback line, and to obtain a first delay associated with the first data line based on the first signal output from the first feedback line;

a second feedback circuit configured to apply the first signal to the second feedback line to traverse and be output from the second feedback line, and to obtain a second delay associated with the second data line based on the first signal output from the second feedback line; and a third feedback circuit configured to apply the first signal to the third feedback line to traverse and be output from the third feedback line, and to obtain a third delay associated with the third data line based on the first signal output from the third feedback line.

18. The display apparatus of claim 17, wherein the plurality of feedback lines further includes:

a fourth feedback line in the fan-out region and adjacent to a fourth data line among the second group of data lines, the fourth data line being in a third edge region of the second display area;

a fifth feedback line in the fan-out region and adjacent to a fifth data line among the second group of data lines, the fifth data line being in a central region of the second display area; and a sixth feedback line in the fan-out region and adjacent to a sixth data line among the second group of data lines, the sixth data line being in a fourth edge region of the second display area opposite to the third edge region of the second display area.

19. The display apparatus of claim 12, wherein the delays are obtained while the display apparatus receives a boot-up command from an external host to perform a boot-up operation.

20. A display apparatus comprising:

a display panel connected to a plurality of gate lines;

a gate driver configured to generate a plurality of gate signals, and to apply the plurality of gate signals to the plurality of gate lines; and a plurality of feedback lines in a fan-out region between the display panel and the gate driver, wherein the gate driver is further configured to apply a first signal to each of the plurality of feedback lines, and to measure delays by the fan-out region based on a return time of the first signal, the delays being associated with the plurality of gate lines, and wherein the gate driver is further configured to control output times of the plurality of gate signals based on the measured delays.

* * * * *